US012460393B2

(12) United States Patent
Ohishi et al.

(10) Patent No.: US 12,460,393 B2
(45) Date of Patent: Nov. 4, 2025

(54) WEAR RESISTANT COMPONENT

(71) Applicant: KOMATSU LTD., Tokyo (JP)

(72) Inventors: Masayuki Ohishi, Tokyo (JP); Masakuni Ueda, Tokyo (JP); Naomi Kobayashi, Tokyo (JP); Hajime Aoyama, Tokyo (JP)

(73) Assignee: KOMATSU LTD., Tokyo (JP)

( * ) Notice: Subject to any disclaimer, the term of this patent is extended or adjusted under 35 U.S.C. 154(b) by 640 days.

(21) Appl. No.: 17/913,396

(22) PCT Filed: Mar. 31, 2021

(86) PCT No.: PCT/JP2021/014040
§ 371 (c)(1),
(2) Date: Sep. 21, 2022

(87) PCT Pub. No.: WO2021/205968
PCT Pub. Date: Oct. 14, 2021

(65) Prior Publication Data

US 2023/0167630 A1 Jun. 1, 2023

(30) Foreign Application Priority Data

Apr. 9, 2020 (JP) ..... 2020-070360

(51) Int. Cl.
*E02F 9/28* (2006.01)

(52) U.S. Cl.
CPC ..... *E02F 9/285* (2013.01); *E02F 9/2858* (2013.01)

(58) Field of Classification Search
CPC ..... E02F 9/285; E02F 9/2858; E02F 9/2833; E02F 9/2808; E02F 9/2883; E02F 9/2816; E02F 9/2866; E02F 3/40; B22F 5/08; B22F 7/08; C22C 1/055; C22C 1/1015; C22C 1/1036; C22C 33/0242
See application file for complete search history.

(56) References Cited

U.S. PATENT DOCUMENTS

| | | | | |
|---|---|---|---|---|
| 5,081,774 | A | 1/1992 | Kuwano | |
| 5,375,350 | A | 12/1994 | Maybon | |
| 12,123,177 | B2 * | 10/2024 | Berton | C22C 1/1015 |
| 2009/0047543 | A1 | 2/2009 | Garber et al. | |
| 2019/0186108 | A1 | 6/2019 | Tsukamoto et al. | |
| 2021/0131076 | A1 | 5/2021 | Berton | |
| 2022/0412059 | A1 * | 12/2022 | Harding | E02F 9/2883 |

FOREIGN PATENT DOCUMENTS

| | | | |
|---|---|---|---|
| JP | S49-005202 | U | 1/1974 |
| JP | S56-121766 | U | 9/1981 |
| JP | S64-55370 | A | 3/1989 |

(Continued)

OTHER PUBLICATIONS

Oct. 13, 2023 Office Action issued in Australian Patent Application No. 2021251552.

*Primary Examiner* — Joseph M Rocca
*Assistant Examiner* — Robert E Pezzuto
(74) *Attorney, Agent, or Firm* — Oliff PLC

(57) ABSTRACT

A wear resistant component includes a matrix portion made of metal, and a core that is embedded in the matrix portion and is higher in hardness than the matrix portion. The core has a shape that follows a shape of at least a portion of a surface of the matrix portion.

6 Claims, 8 Drawing Sheets

(56) References Cited

FOREIGN PATENT DOCUMENTS

| | | | |
|---|---|---|---|
| JP | H02-176026 | A | 7/1990 |
| JP | H04-070387 | U | 6/1992 |
| JP | H09-192819 | A | 7/1997 |
| KR | 10-2010-0131909 | A | 12/2010 |
| WO | 2010/136055 | A1 | 12/2010 |
| WO | 2010/136208 | A1 | 12/2010 |
| WO | 2019/211268 | A1 | 11/2019 |

* cited by examiner

WEAR RESISTANT COMPONENT

TECHNICAL FIELD

The present disclosure relates to a wear resistant component.

The present application claims priority based on Japanese Patent Application No. 2020-070360 filed on Apr. 9, 2020, the entire contents of which are incorporated herein by reference.

BACKGROUND ART

In wear resistant components such as teeth, tooth adapters, ripping tips, and others of work machines, it has been proposed to dispose a member of high hardness inside for the purpose of improving wear resistance (see, for example, Japanese Patent Application Laid-Open No. H1-55370 (Patent Literature 1), Japanese Patent Application Laid-Open No. H2-176026 (Patent Literature 2), and Japanese Patent Application Laid-Open No. H9-192819 (Patent Literature 3)).

CITATION LIST

Patent Literature

Patent Literature 1: Japanese Patent Application Laid-Open No. H1-55370

Patent Literature 2: Japanese Patent Application Laid-Open No. H2-176026

Patent Literature 3: Japanese Patent Application Laid-Open No. H9-192819

SUMMARY OF INVENTION

Technical Problem

As described above, there is a need for improved wear resistance in teeth, tooth adapters, ripping tips, and other wear resistant components. One of the objects of the present disclosure is to provide a wear resistant component with improved wear resistance.

Solution to Problem

A wear resistant component of the present disclosure includes: a matrix portion made of metal, and a core that is embedded in the matrix portion and is higher in hardness than the matrix portion. The core has a shape that follows a shape of at least a portion of a surface of the matrix portion.

Advantageous Effects of Invention

According to the wear resistant component described above, a wear resistant component with improved wear resistance can be provided.

DESCRIPTION OF EMBODIMENTS

Outline of Embodiments

Figure 1:
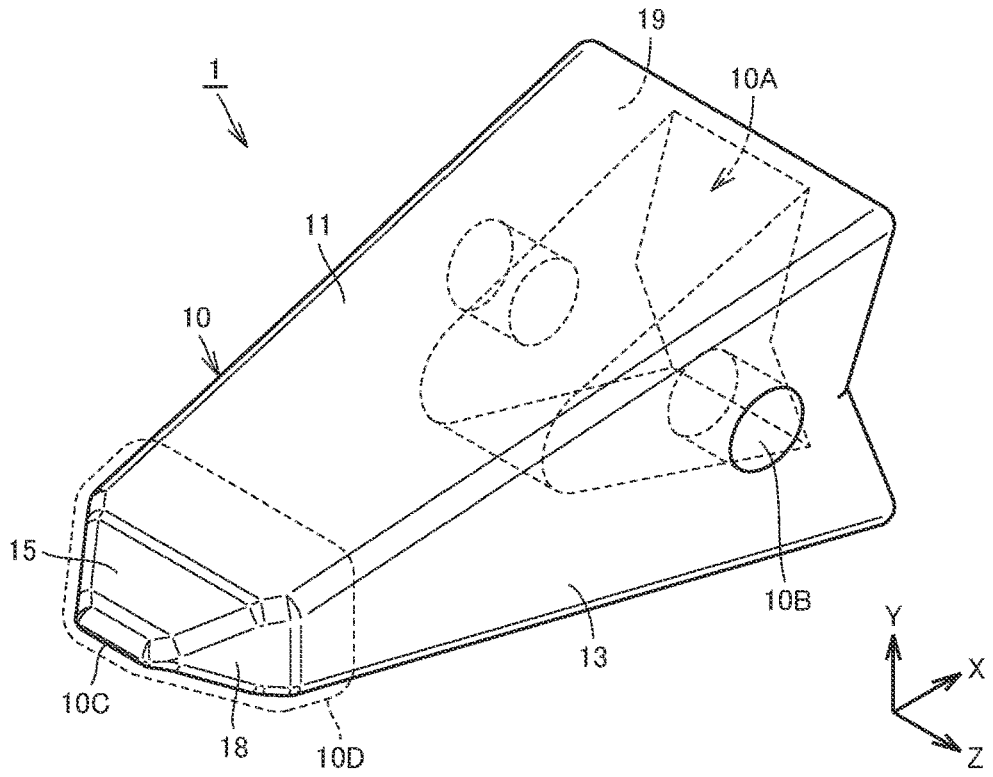
FIG. 1 is a schematic perspective view showing the appearance of a tooth in Embodiment 1.

A wear resistant component according to the present disclosure includes: a matrix portion made of metal, and a core that is embedded in the matrix portion and is higher in hardness than the matrix portion. The core has a shape that follows a shape of at least a portion of a surface of the matrix portion.

In the wear resistant component according to the present disclosure, the core having a shape that follows the shape of at least a portion of the surface of the matrix portion and having a higher hardness than the matrix portion is embedded in the matrix portion. With the core being shaped to follow the shape of at least a portion of the surface of the matrix portion, the progress of local wear is suppressed in the region where the core has a shape that follows the surface of the matrix portion. As a result, the wear resistance of the wear resistant component is improved. As such, according to the wear resistant component of the present disclosure, a wear resistant component with improved wear resistance can be provided.

In the above wear resistant component, the core may include a body portion, and a bar member that protrudes from the body portion. With this, the progress of wear in a region closer to the surface of the body portion can be suppressed by the bar member.

In the above wear resistant component, the bar member may extend perpendicularly to the surface of the matrix portion. With this, when the wear progresses with a distal end of the bar member exposed from the matrix portion, the change in shape of the distal end of the bar member exposed from the matrix portion is suppressed. As a result, the progress of wear can be stably suppressed.

In the above wear resistant component, the bar member may have a distal end exposed on the surface of the matrix portion. With this, the bar member (core) can contribute to the suppression of the progress of wear from the beginning of the wear progression. Further, in the case of producing the wear resistant component by casting, it is readily possible to place the core in an appropriate position by bringing the distal end (end face) of the bar member into contact with a wall surface defining a mold cavity to thereby support the core, and then pouring the metal constituting the matrix portion in a molten state.

In the above wear resistant component, the matrix portion may include a distal end region that tapers toward a distal end. The core may be arranged in the distal end region and may have a shape corresponding to an external shape of the distal end region. This can effectively suppress the wear of the distal end region.

SPECIFIC EMBODIMENTS

Specific embodiments of the wear resistant component of the present disclosure will be described below with reference to the drawings. In the drawings referenced below, the same or corresponding portions are denoted by the same reference numerals and the description thereof will not be repeated.

Embodiment 1

Figure 2:
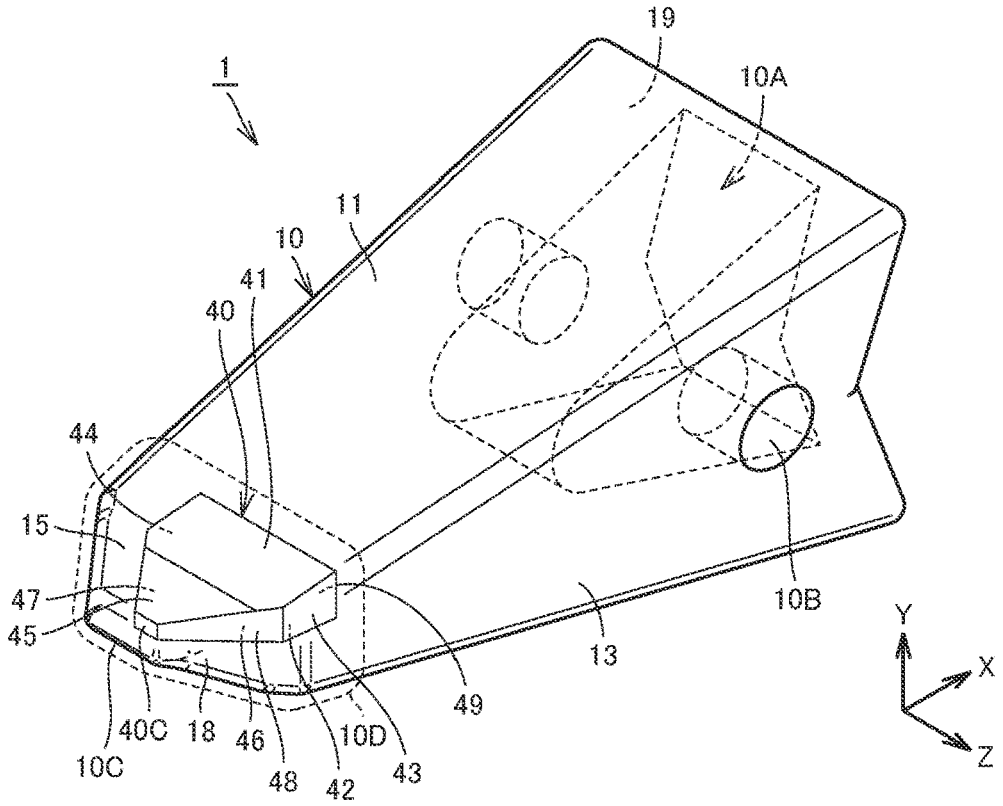
FIG. 2 is a schematic perspective view showing the internal structure of the tooth in Embodiment 1.
Figure 3:
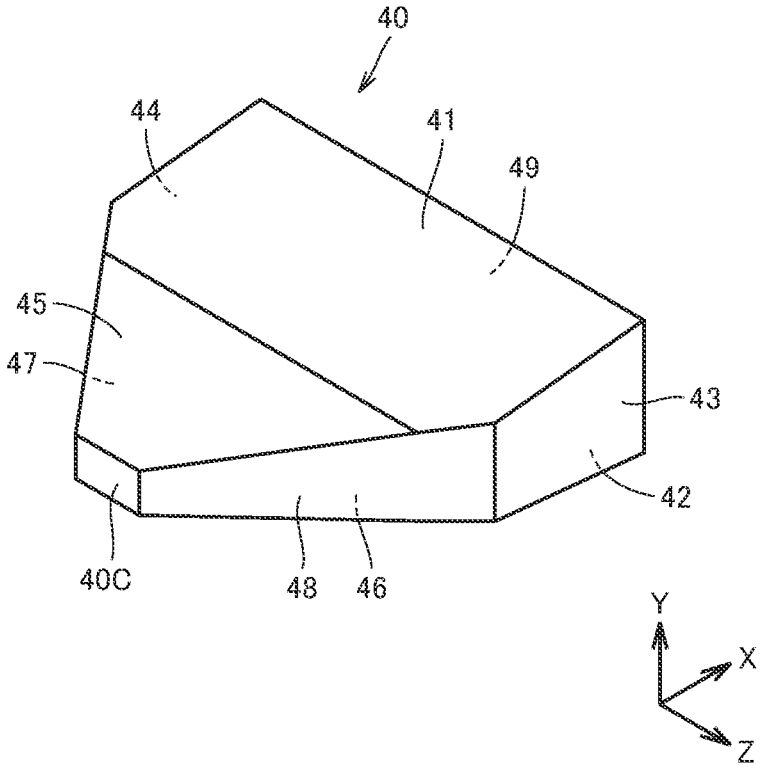
FIG. 3 is a schematic perspective view showing the structure of a core in Embodiment 1.
Figure 4:
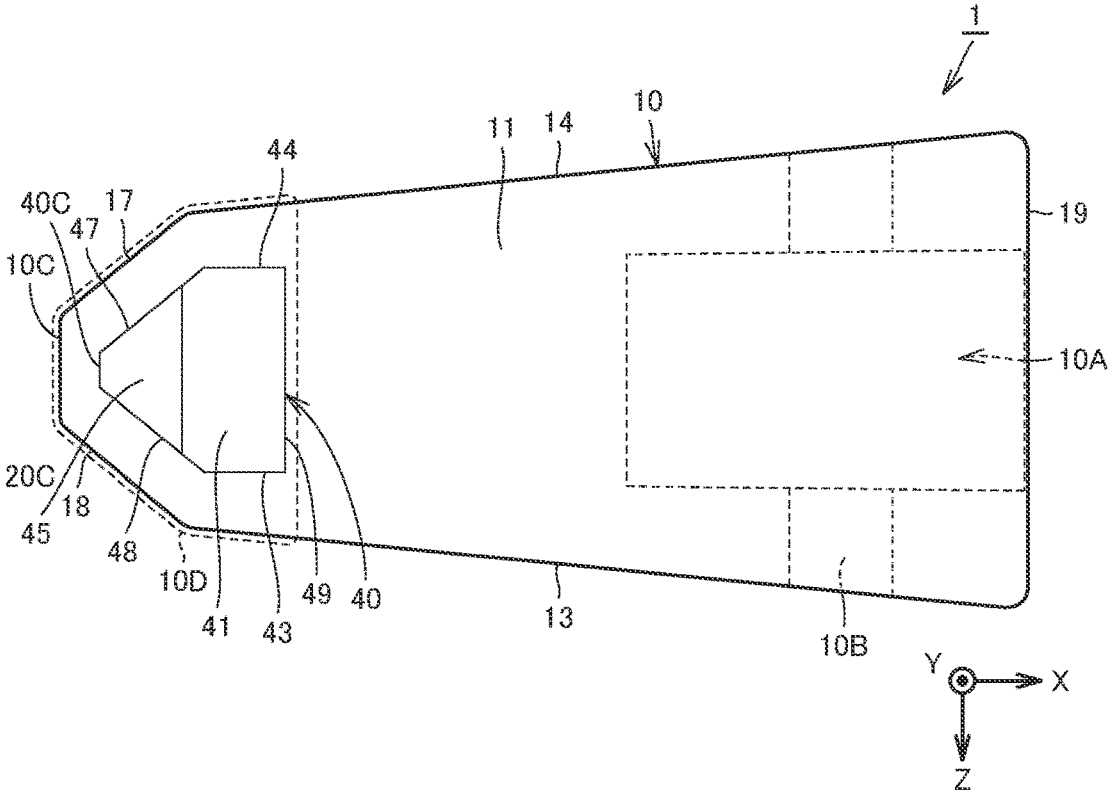
FIG. 4 is a schematic plan view showing the internal structure of the tooth in Embodiment 1.
Figure 5:
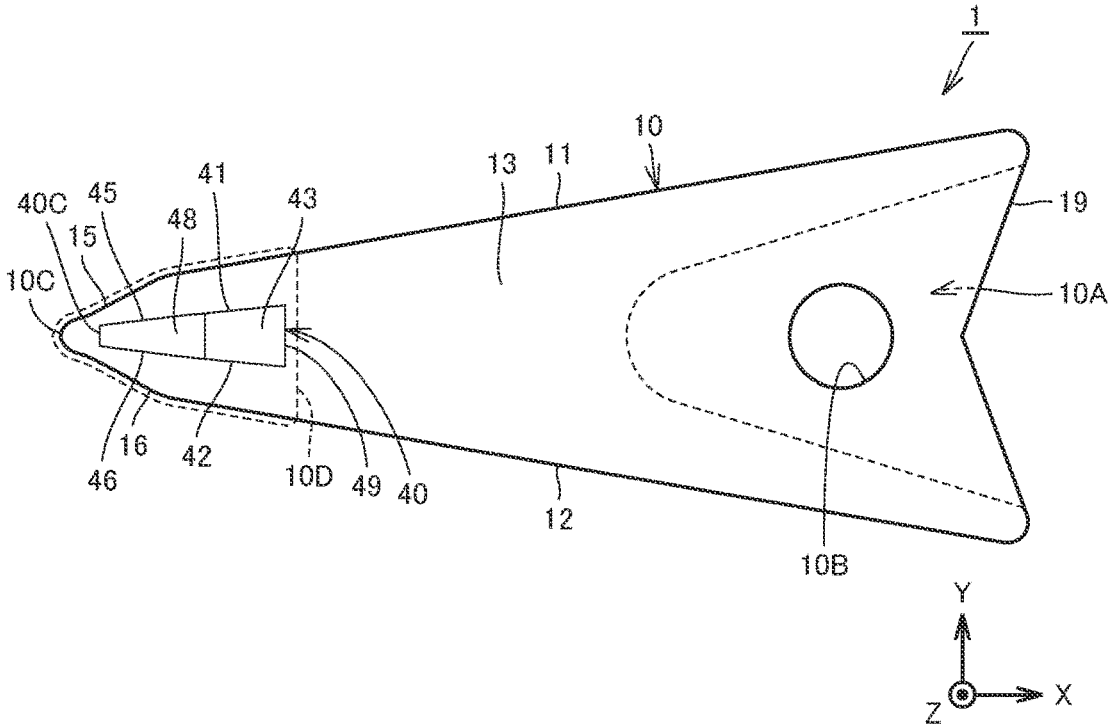
FIG. 5 is a schematic side view showing the internal structure of the tooth in Embodiment 1.

First, a tooth of Embodiment 1 as an example of the wear resistant component according to the present disclosure will be described with reference to FIGS. 1 to 5. FIG. 1 is a schematic perspective view showing the appearance of a tooth in Embodiment 1. FIG. 2 is a schematic perspective view showing the internal structure of the tooth in Embodiment 1. FIG. 2 corresponds to the state of looking through the interior of the tooth in FIG. 1. FIG. 3 is a schematic perspective view showing the structure of a core in Embodiment 1. FIG. 4 is a schematic plan view showing the internal structure of the tooth in Embodiment 1. FIG. 5 is a schematic side view showing the internal structure of the tooth in Embodiment 1. In FIGS. 1 to 5, the X axis direction corresponds to a longitudinal direction (distal-proximal direction) of the tooth. In FIGS. 1 to 5, the Y axis direction corresponds to a thickness direction of the tooth. In FIGS. 1 to 5, the Z axis direction corresponds to a width direction of the tooth. FIG. 4 is a plan view in the X-Z plane. FIG. 5 is a side view in the X-Y plane.

Referring to FIGS. 1, 2, 4, and 5, a matrix portion 10 constituting the surface of a tooth 1 in Embodiment 1 includes a distal end 10C and a proximal end 19. The matrix portion 10 includes a first surface 11, a second surface 12, a third surface 13, a fourth surface 14, a fifth surface 15, a sixth surface 16, a seventh surface 17, and an eighth surface 18.

Referring to FIG. 5, the first surface 11 and the second surface 12 are each connected to the proximal end 19. The first surface 11 and the second surface 12 are arranged spaced apart from each other in the Y axis direction such that the distance between them decreases as they approach the distal end 10C. The fifth surface 15 and the sixth surface 16 connect the first surface 11 and the second surface 12 to the distal end 10C, respectively. The fifth surface 15 and the sixth surface 16 are arranged such that their distance from each other decreases as they approach the distal end 10C. In the X-Y plane, the angle made by the fifth surface 15 and the sixth surface 16 is larger than the angle made by the first surface 11 and the second surface 12.

Referring to FIG. 4, the third surface 13 and the fourth surface 14 are each connected to the proximal end 19. The third surface 13 and the fourth surface 14 are arranged spaced apart from each other in the Z axis direction such that the distance between them decreases as they approach the distal end 10C. The seventh surface 17 and the eighth surface 18 connect the fourth surface 14 and the third surface 13 to the distal end 10C, respectively. The seventh surface 17 and the eighth surface 18 are arranged such that their distance from each other decreases as they approach the distal end 10C. In the X-Z plane, the angle made by the seventh surface 17 and the eighth surface 18 is larger than the angle made by the third surface 13 and the fourth surface 14. The distal end 10C is a surface (region) that extends linearly in the Z axis direction.

Referring to FIGS. 1, 2, 4, and 5, the proximal end 19 has a recess 10A formed toward the distal end (recessed in the X axis direction). The matrix portion 10 has a through hole 10B formed to penetrate from the third surface 13 to the fourth surface 14. The through hole 10B intersects the recess 10A. That is, the through hole 10B is in communication with the recess 10A.

The tooth 1 is attached, for example, to a bucket (not shown) of a hydraulic excavator. More specifically, a tooth adapter (not shown) is attached to an outer edge of an opening of the bucket of the hydraulic excavator. This tooth adapter has its distal end portion inserted into the recess 10A formed at the proximal end 19 of the tooth 1 (matrix portion 10). The through hole 10B receives a pin (not shown) inserted to penetrate through the through hole 10B. The tooth 1 is thus attached to the bucket via the tooth adapter.

Referring to FIGS. 2 to 5, the tooth 1 includes the matrix portion 10 made of metal, and a core 40 embedded in the matrix portion 10. For the metal constituting the matrix portion 10, cast steel, for example, can be adopted. The cast steel that can be adopted is not particularly limited as long as it has appropriate wear resistance. For example, Cr—Mo cast steel, Cr—Mo-V-W cast steel, Cr—Mo—Ni cast steel, high Mn cast steel, boron cast steel, Cr—Mo—V cast steel, high Cr cast steel, or other low alloy cast steel may be adopted. Further, cast steel having the component composition of carbon steel for machine structural use or alloy steel for machine structural use specified in JIS standard (for example, S45C or SCM435, as well as manganese steel (SMn), chromium steel (SCr), chromium-molybdenum steel (SCM), or the like containing an equivalent amount of carbon) may be adopted. For the metal constituting the matrix portion 10, cast iron with a higher carbon content than cast steel may also be adopted. The core 40 is higher in hardness than the matrix portion 10. The core 40 may be a sintered body of particles or powder of a hard material such as high-speed tool steel, cemented carbide, or the like. Forming of the core 40 prior to sintering may be performed, for example, using a 3D printer. The core 40 may be fabricated using rolling (including special shape rolling), cutting, forging, casting, or other method in place of, or in combination with, sintering. The core 40 may have, formed on its surface, an overlay that contains particles or powder of high-speed tool steel, cemented carbide, or the like.

Referring to FIGS. 2 to 5, the core 40 has a surface (external shape) that includes a first surface 41, a second surface 42, a third surface 43, a fourth surface 44, a fifth surface 45, a sixth surface 46, a seventh surface 47, an eighth surface 48, a ninth surface 49, and a distal end 40C. The first surface 41 is along the first surface 11 of the matrix portion 10. The second surface 42 is along the second surface 12 of the matrix portion 10. The third surface 43 is along the third surface 13 of the matrix portion 10. The fourth surface 44 is along the fourth surface 14 of the matrix portion 10. The fifth surface 45 is along the fifth surface 15 of the matrix portion 10. The sixth surface 46 is along the sixth surface 16 of the matrix portion 10. The seventh surface 47 is along the seventh surface 17 of the matrix portion 10. The eighth surface 48 is along the eighth surface 18 of the matrix portion 10. The distal end 40C is along the distal end 10C of the matrix portion 10 (tooth 1). The ninth surface 49 is a surface (facing the proximal end 19) opposite to the distal end 40C in the X axis direction.

The matrix portion 10 includes a distal end region 10D that tapers toward the distal end 10C. The core 40 is arranged in the distal end region 10D and has a shape corresponding to an external shape of the distal end region 10D. That is, the external shape of the core 40 follows that of the distal end region 10D. Explained from another perspective, the external shape of the core 40 corresponds to a shape obtained by substantially uniformly reducing the external shape of the distal end region 10D.

In the tooth 1 of Embodiment 1, the core 40 having a shape that follows the shape of the surface of the matrix portion 10 and having a higher hardness than the matrix portion 10 is embedded in the matrix portion 10. This suppresses the progress of local wear in the region where the core 40 has a shape that follows the surface of the matrix portion 10. As a result, the wear resistance of the tooth 1 is improved. As such, the tooth 1 in Embodiment 1 is a wear resistant component with improved wear resistance.

The matrix portion 10 of the tooth 1 in Embodiment 1 includes the distal end region 10D which tapers toward the distal end 10C. The core 40 is arranged in the distal end region 10D and has a shape corresponding to the external shape of the distal end region 10D. This enables effective suppression of the wear of the distal end region 10D.

It should be noted that the core 40 may be disposed inside a framework portion that has a three-dimensional lattice structure formed with a plurality of bar-shaped members and is embedded in the matrix portion 10. At least some of the bar-shaped members may have end faces exposed on the surface of the matrix portion 10. With this, in the case of producing the tooth 1 by casting, it is readily possible to place the core 40 in an appropriate position by bringing the end faces of the bar-shaped members constituting the framework portion into contact with a wall surface defining a mold cavity to thereby support the framework portion and placing the core 40 inside the framework portion, and then pouring the metal constituting the matrix portion 10 in a molten state. From the standpoint of improving the wear resistance, the framework portion preferably has a higher hardness than that (of about HV 500) of the matrix portion 10. On the other hand, from the standpoint of achieving the function of supporting the core 40, the framework portion may have a hardness comparable to, or lower than, that of the matrix portion 10. The material constituting the framework portion may be, for example, mild steel.

Embodiment 2

Another embodiment, Embodiment 2, will now be described with reference to FIGS. 6 to 10. The tooth as a wear resistant component of Embodiment 2 basically has a similar structure and exerts similar effects as in Embodiment 1. However, the tooth of Embodiment 2 differs from that of Embodiment 1 in the following points.

Figure 6:
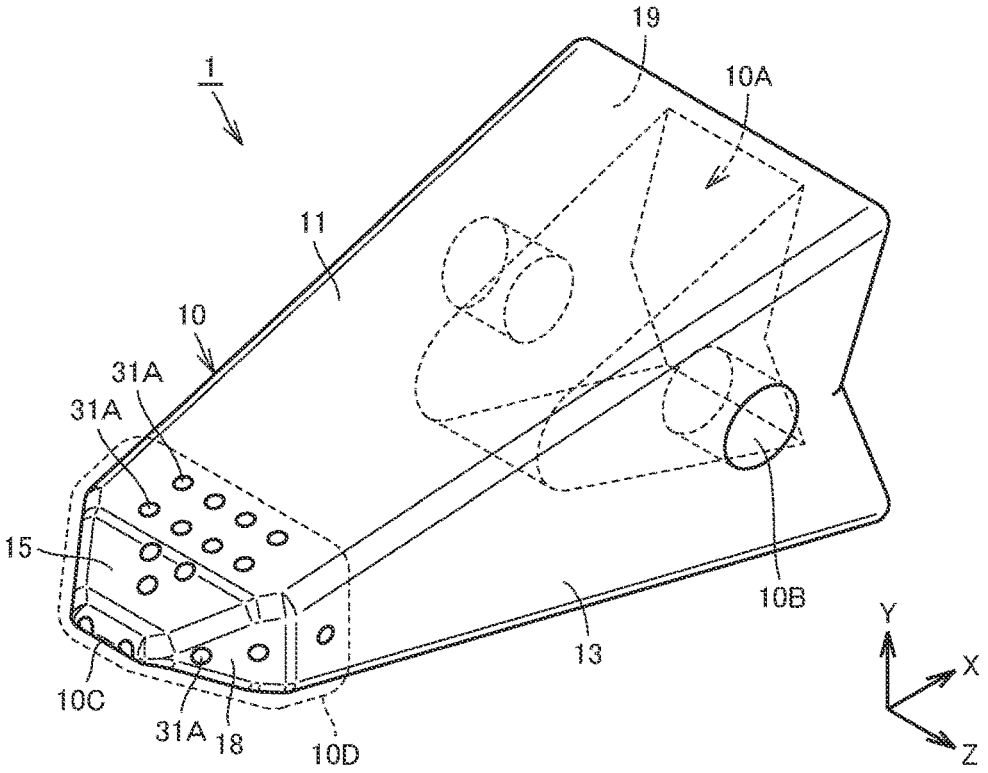
FIG. 6 is a schematic perspective view showing the appearance of a tooth in Embodiment 2.
Figure 7:
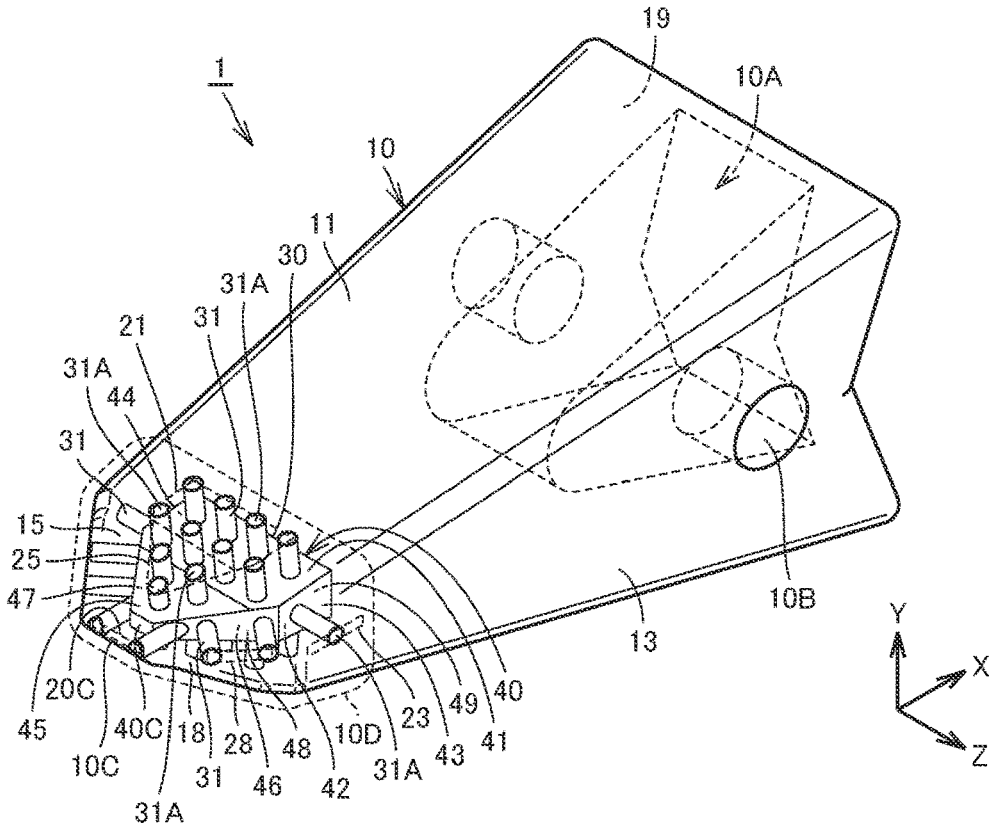
FIG. 7 is a schematic perspective view showing the internal structure of the tooth in Embodiment 2.
Figure 8:
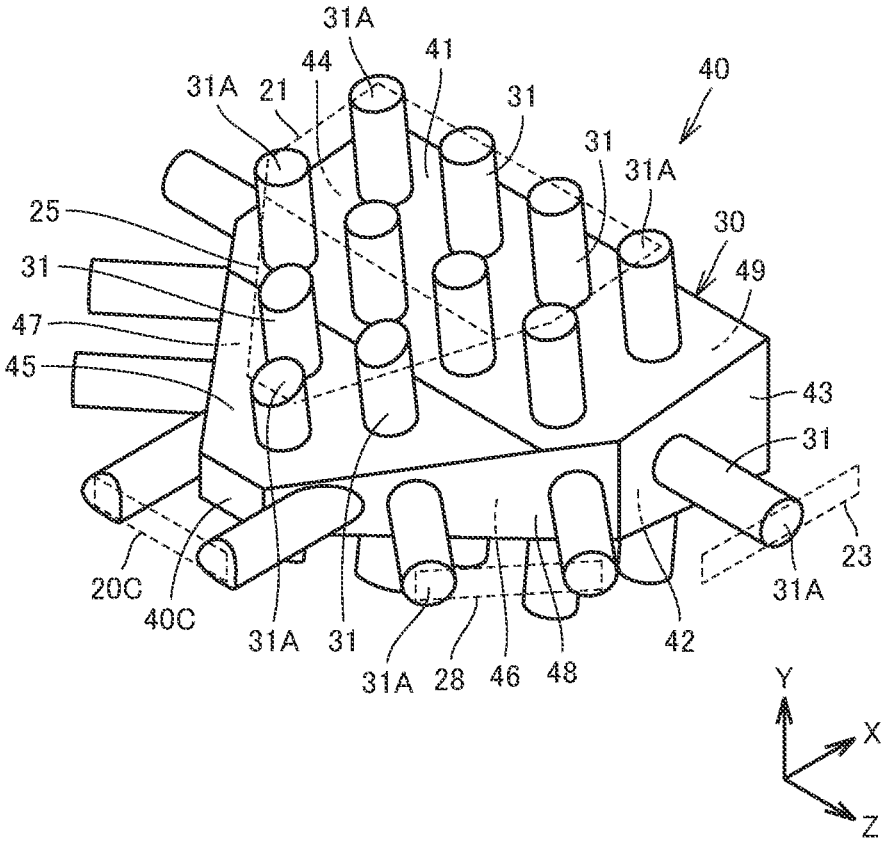
FIG. 8 is a schematic perspective view showing the structure of a core in Embodiment 2.
Figure 9:
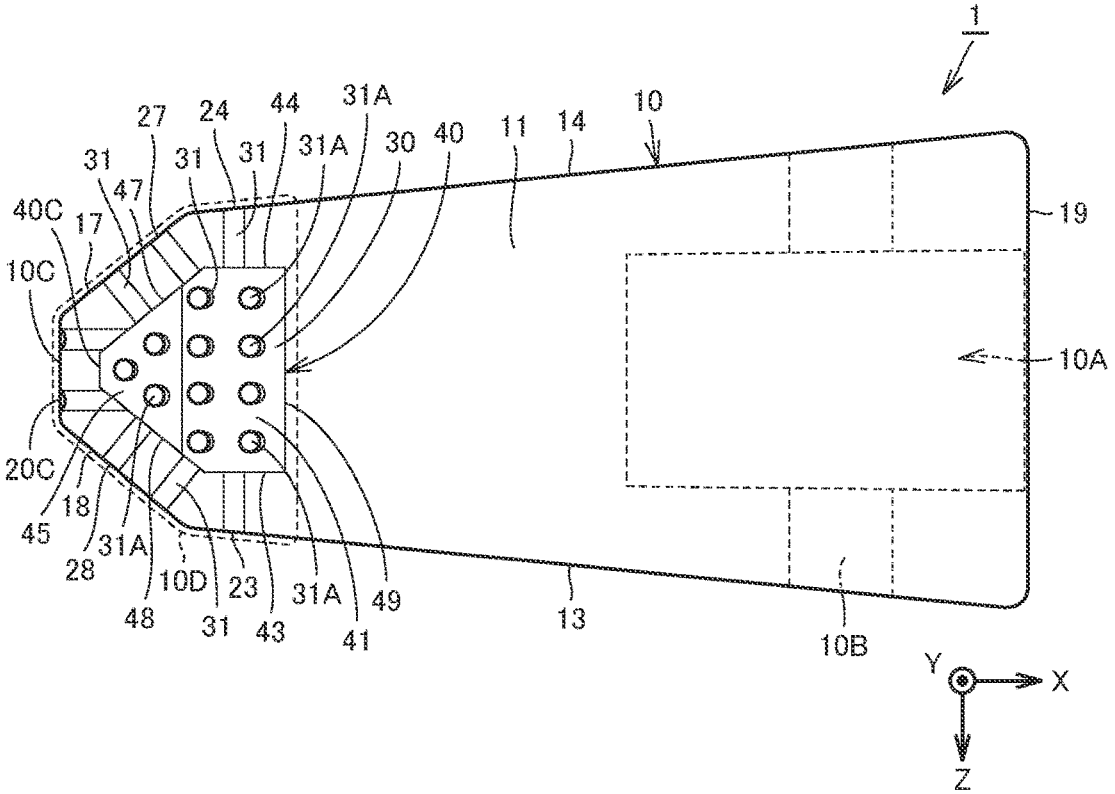
FIG. 9 is a schematic plan view showing the internal structure of the tooth in Embodiment 2.
Figure 10:
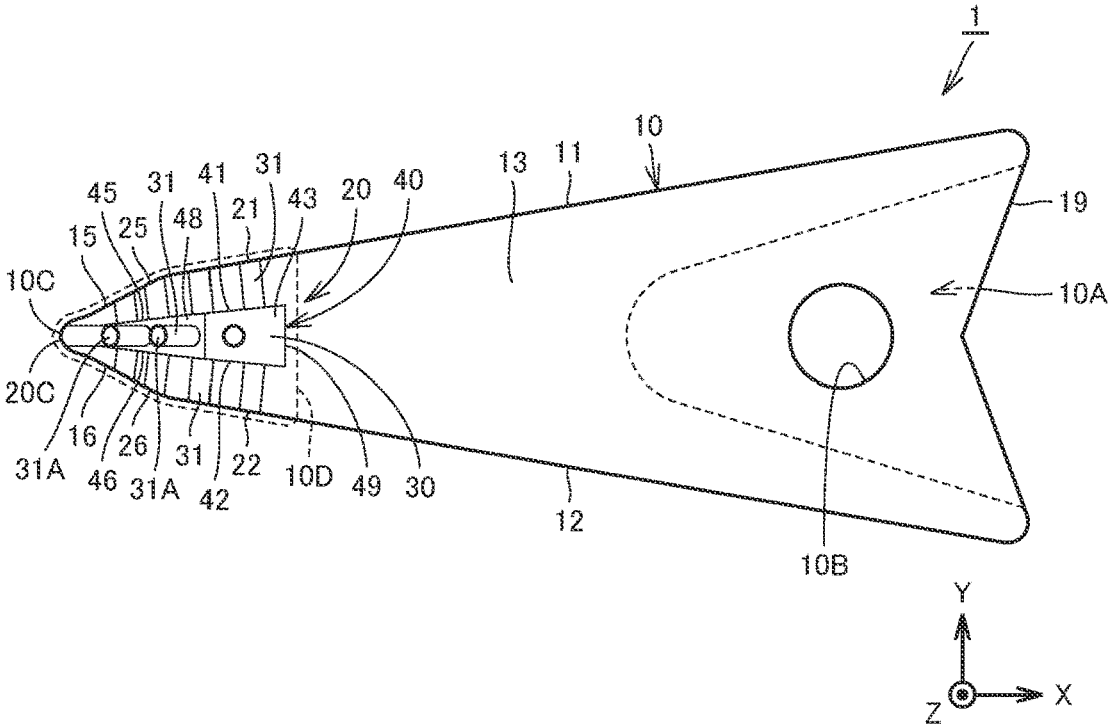
FIG. 10 is a schematic side view showing the internal structure of the tooth in Embodiment 2.

FIG. 6 is a schematic perspective view showing the appearance of a tooth in Embodiment 2. FIG. 7 is a schematic perspective view showing the internal structure of the tooth in Embodiment 2. FIG. 7 corresponds to the state of looking through the interior of the tooth in FIG. 6. FIG. 8 is a schematic perspective view showing the structure of a core in Embodiment 2. FIG. 9 is a schematic plan view showing the internal structure of the tooth in Embodiment 2. FIG. 10 is a schematic side view showing the internal structure of the tooth in Embodiment 2. In FIGS. 6 to 10, the X axis direction corresponds to a longitudinal direction (distal-proximal direction) of the tooth. In FIGS. 6 to 10, the Y axis direction corresponds to a thickness direction of the tooth. In FIGS. 6 to 10, the Z axis direction corresponds to a width direction of the tooth. FIG. 9 is a plan view in the X-Z plane. FIG. 10 is a side view in the X-Y plane.

Referring to FIG. 8, the core 40 of Embodiment 2 includes a body portion 30, and a bar member 31 that protrudes from the body portion 30. A plurality of bar members 31 protrude from the body portion 30. The plurality of bar members 31 protrude radially from the body portion 30. The body portion 30 has a shape similar to that of the core 40 of Embodiment 1.

The body portion 30 has a surface (external shape) that includes a first surface 41, a second surface 42, a third surface 43, a fourth surface 44, a fifth surface 45, a sixth surface 46, a seventh surface 47, an eighth surface 48, a ninth surface 49, and a distal end 40C. The first surface 41 is along the first surface 11 of the matrix portion 10. The second surface 42 is along the second surface 12 of the matrix portion 10. The third surface 43 is along the third surface 13 of the matrix portion 10. The fourth surface 44 is along the fourth surface 14 of the matrix portion 10. The fifth surface 45 is along the fifth surface 15 of the matrix portion 10. The sixth surface 46 is along the sixth surface 16 of the matrix portion 10. The seventh surface 47 is along the seventh surface 17 of the matrix portion 10. The eighth surface 48 is along the eighth surface 18 of the matrix portion 10. The distal end 40C is along the distal end 10C of the matrix portion 10 (tooth 1). The ninth surface 49 is a surface (facing the proximal end 19) opposite to the distal end 40C in the X axis direction. The bar members 31 protrude from the surface of the body portion 30 which follows the surface of the distal end region 10D. With the core 40 thus including the bar members 31, the progress of wear in a region closer to the surface of the matrix portion 10 can be suppressed by the bar members 31.

Referring to FIGS. 6 to 10, the bar member 31 in Embodiment 2 has a distal end (end face 31A) exposed on the surface of the matrix portion 10. The end faces 31A of at least some of a plurality of bar members 31 (in the present embodiment, the end faces 31A of all the bar members 31) are exposed on the surface of the matrix portion 10. Each bar member 31 protrudes from the body portion 30 in a direction perpendicular to the surface of the matrix portion 10 on which the end face 31A is exposed. The bar member 31 has a solid cylindrical shape. The end face 31A has a circular or elliptical shape.

The first through eighth surfaces 11-18 and the distal end 10C are flush with the end faces 31A exposed thereon. That is, the end faces 31A of the plurality of bar members 31 are contained in a flat or curved surface that follows the surface of the matrix portion 10. Explained from another perspective, the external shape of the core 40 defined by the end faces 31A of the bar members 31 has a shape corresponding to the surface of the matrix portion 10 (surface of the distal end region 10D). The external shape of the core 40 includes a first surface 21, a second surface 22, a third surface 23, a fourth surface 24, a fifth surface 25, a sixth surface 26, a seventh surface 27, an eighth surface 28, and a distal end surface 20C.

The first surface 21 is along the first surface 11 of the matrix portion 10. The second surface 22 is along the second surface 12 of the matrix portion 10. The third surface 23 is along the third surface 13 of the matrix portion 10. The fourth surface 24 is along the fourth surface 14 of the matrix portion 10. The fifth surface 25 is along the fifth surface 15 of the matrix portion 10. The sixth surface 26 is along the sixth surface 16 of the matrix portion 10. The seventh surface 27 is along the seventh surface 17 of the matrix portion 10. The eighth surface 28 is along the eighth surface 18 of the matrix portion 10. The distal end 20C is along the distal end 10C of the matrix portion 10 (tooth 1).

With the end faces 31A being thus exposed on the first through eighth surfaces 11-18 and the distal end 10C, the core 40 can contribute to the suppression of the progress of wear from the beginning of the wear progression. Further, in the case of producing the tooth 1 by casting, it is readily possible to place the core 40 in an appropriate position by bringing the end faces 31A of the bar members 31 constituting the core 40 into contact with a wall surface defining a mold cavity to thereby support the core 40, and then pouring the metal constituting the matrix portion 10 in a molten state.

Embodiment 3

An example of application of the present invention to a side protector will now be described as Embodiment 3 with reference to FIGS. 11 and 12. The side protector as a wear resistant component of Embodiment 3 has a structure in which the configuration similar to that of the tooth of Embodiment 1 is applied to the side protector.

Figure 11:
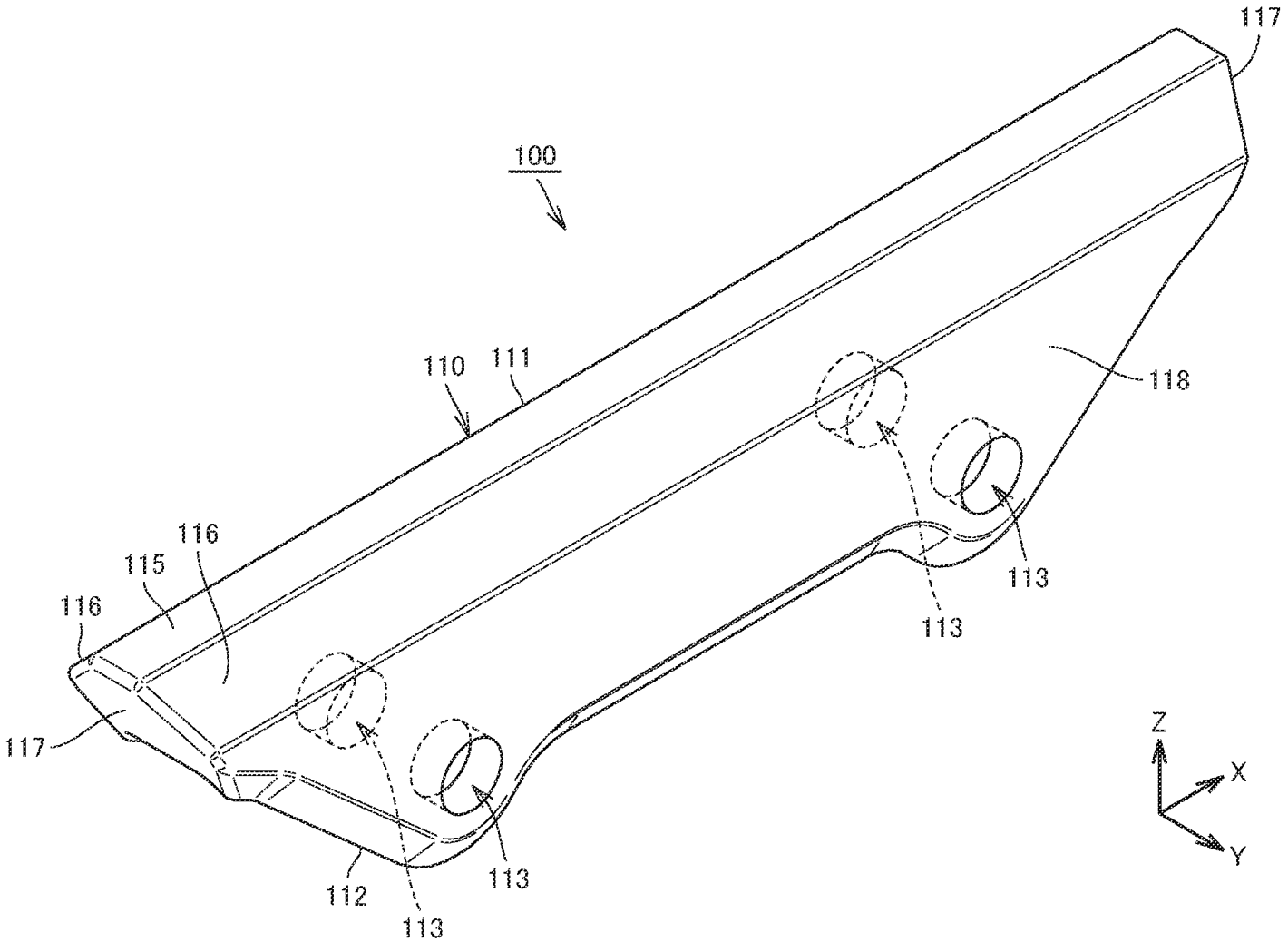
FIG. 11 is a schematic perspective view showing the appearance of a side protector in Embodiment 3.

FIG. 11 is a schematic perspective view showing the appearance of a side protector in Embodiment 3. FIG. 12 is a schematic perspective view showing the internal structure of the side protector in Embodiment 3. FIG. 12 corresponds to the state of looking through the interior of the side protector in FIG. 11.

Figure 12:
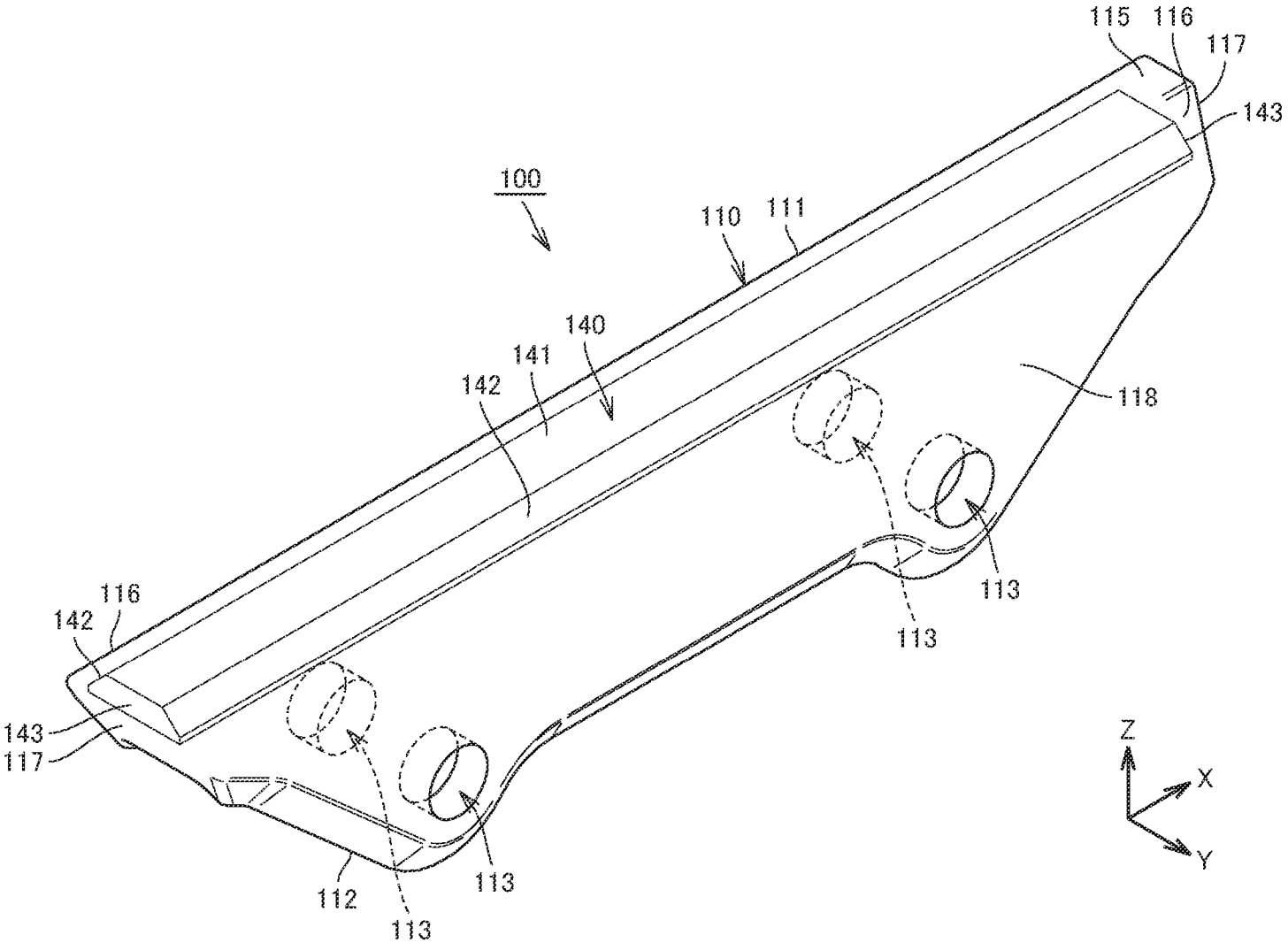
FIG. 12 is a schematic perspective view showing the internal structure of the side protector in Embodiment 3.

Referring to FIGS. 11 and 12, a side protector 100 in Embodiment 3 includes a body portion 111 and a pair of leg portions 112 connected to the body portion 111. The body portion 111 has a bar-like shape that extends along an X axis direction (first direction). The pair of leg portions 112 are connected to respective ends in a width direction (Y axis direction as a second direction) of the body portion 111. The leg portions 112 are arranged to rise from the body portion 111 along a Z axis direction (third direction). Each leg portion 112 has a plate-like shape that extends along the X-Z plane. The pair of leg portions 112 are arranged parallel to each other. The pair of leg portions 112 each have a pair of through holes 113 penetrating the leg portion 112 in the thickness direction, formed spaced apart from each other in the X axis direction. The through holes 113 of the pair of leg portions 112 are arranged at the same positions in the X axis direction. The side protector 100 is a wear resistant component which is attached, for example, to an outer edge portion surrounding an opening of a bucket (not shown) of a hydraulic excavator to thereby suppress the wear of the outer edge portion. The side protector 100 is fixed to the bucket by fixing members such as pins being inserted into the through holes 113 in the state where a plate-like portion constituting the outer edge of the opening of the bucket is inserted between the pair of leg portions 112.

A matrix portion 110 that constitutes the surface of the side protector 100 in Embodiment 3 includes a pair of end faces 117 which are flat surfaces constituting respective ends in a longitudinal direction (X axis direction) of the body portion 111. The matrix portion 110 further includes a top face 115 which is a flat surface extending in the X axis direction and connecting the pair of end faces 117, a pair of inclined faces 116 which are flat surfaces connected to respective ends in a width direction (Y direction) of the top face 115 and inclined with respect to the top face 115, and a pair of side faces 118 which are flat surfaces connected to opposite sides of the pair of inclined faces 116 from the top face 115 and inclined with respect to the inclined faces 116. The top face 115 is a surface along the X-Y plane. The side faces 118 are surfaces along the X-Z plane. That is, the plane including the top face 115 is orthogonal to the planes including the side faces 118.

Referring to FIG. 12, the side protector 100 includes the matrix portion 110 made of metal, and a core 140 that is arranged inside the matrix portion 110 and is higher in hardness than the matrix portion 110. For the metal constituting the matrix portion 10, cast steel or cast iron, for example, can be adopted as in Embodiments 1 and 2 above.

The core 140 may be composed of a material similar to that of Embodiment 1 above. The core 140 has a surface (external shape) that includes a top face 141, a pair of inclined faces 142, and a pair of end faces 143. The top face 141 is along the top face 115 of the matrix portion 110. The pair of inclined faces 142 are along the pair of inclined faces 116 of the matrix portion 110. The core 140 is arranged in the matrix portion 110 corresponding to the body portion 111 and has a shape corresponding to the external shape of the body portion 111.

Since the side protector 100 of Embodiment 3 has the core 140, even if the matrix portion 110 wears down, the core 140 having a high hardness can suppress the progress of wear. Further, in Embodiment 3, with the core 140 being shaped to follow the shape of at least a portion of the surface of the matrix portion 110, progress of local wear is suppressed in the region where the core 140 has a shape that follows the surface of the matrix portion 110. As such, the side protector 100 in Embodiment 3 is a wear resistant component with improved wear resistance.

While the tooth and the side protector have been described in Embodiments 1 to 3 above as examples of the wear resistant component of the present disclosure, the wear resistant component of the present disclosure is not limited thereto. The wear resistant component of the present disclosure is applicable to various components that require wear resistance due to the use, for example, in applications where they come into contact with earth, sand, bedrock, or the like. The wear resistant component of the present disclosure is particularly suitably applicable to components for which wear of the distal end portion is a problem, such as the above-described tooth and side protector, as well as tooth adopter, ripping tip, track chain member constituting a track, lug bar, and the like. The wear resistant component of the present disclosure is also applicable to a corner guard (component attached to a bottom corner) and a lip shroud (component attached to a bucket lip), which are components for suppressing progress of local wear of the bucket, as with the above-described side protector. While the application of the wear resistant component of the present disclosure to components of the bucket of a hydraulic excavator has been described above, the wear resistant component of the present disclosure is also applicable to components of a bucket of a wheel loader.

It should be understood that the embodiments disclosed herein are illustrative and non-restrictive in every respect. The scope of the present invention is defined by the terms of the claims, rather than the description above, and is intended to include any modifications within the scope and meaning equivalent to the terms of the claims.

REFERENCE SIGNS LIST

1: tooth; 10: matrix portion; 10A: recess; 10B: through hole; 10C: distal end; 10D: distal end region; 11: first surface; 12: second surface; 13: third surface; 14: fourth surface; 15: fifth surface; 16: sixth surface; 17:

seventh surface; 18: eighth surface; 19: proximal end; 20C: distal end surface; 21: first surface; 22: second surface; 23: third surface; 24: fourth surface; 25: fifth surface; 26: sixth surface; 27: seventh surface; 28: eighth surface; 30: body portion; 31: bar member; 31A: end face; 40: core; 40C: distal end; 41: first surface; 42: second surface; 43: third surface; 44: fourth surface; 45: fifth surface; 46: sixth surface; 47: seventh surface; 48: eighth surface; 49: ninth surface; 100: side protector; 110: matrix portion; 111: body portion; 112: leg portion; 113: through hole; 115: top face; 116: inclined face; 117: end face; 118: side face; 140: core; 141: top face; and 142: inclined face.

The invention claimed is:

1. A wear resistant component comprising:

a matrix portion made of metal; and a core embedded in the matrix portion, the core being higher in hardness than the matrix portion, wherein:

the core has a shape that follows a shape of at least a portion of a surface of the matrix portion, and the core includes:

a body portion, and a bar member protruding from the body portion; and the body portion is located inside the matrix portion so as not to be exposed from the surface of the matrix portion.

2. The wear resistant component according to claim 1, wherein the bar member extends perpendicularly to the surface of the matrix portion.

3. The wear resistant component according to claim 1, wherein the bar member has a distal end exposed on the surface of the matrix portion.

4. The wear resistant component according to claim 1, wherein the matrix portion includes a distal end region that tapers toward a distal end, and the core is arranged in the distal end region and has a shape corresponding to an external shape of the distal end region.

5. The wear resistant component according to claim 2, wherein the bar member has a distal end exposed on the surface of the matrix portion.

6. A wear resistant component comprising:

a matrix portion made of metal; and a core embedded in the matrix portion, the core being higher in hardness than the matrix portion, the core having a shape that follows a shape of at least a portion of a surface of the matrix portion, the core including:

a body portion; and a bar member protruding from the body portion, the bar member extending perpendicularly to the surface of the matrix portion, the bar member having a distal end exposed on the surface of the matrix portion, the matrix portion including a distal end region that tapers toward a distal end, and the core being arranged in the distal end region and having a shape corresponding to an external shape of the distal end region, and the body portion being located inside the matrix portion so as not to be exposed from the surface of the matrix portion.

* * * * *